US006393870B2

(12) United States Patent
Eppler et al.

(10) Patent No.: US 6,393,870 B2
(45) **Date of Patent: *May 28, 2002**

(54) CIRCULAR KNITTING MACHINE

(75) Inventors: Hans Martin Eppler, Messstetten; Stefan Seeger, Jungingen; Dietmar Traenkle, Balingen, all of (DE)

(73) Assignee: Sipra Patententwicklungs-und Beteiligungsgesellschaft mbH, Albstadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/829,765

(22) Filed: Apr. 10, 2001

(30) Foreign Application Priority Data

Apr. 14, 2000 (DE) ..... 100 18 841

(51) Int. Cl.[7] ..... P04B 9/00
(52) U.S. Cl. ..... 66/8
(58) Field of Search ..... 66/8, 7, 28, 56

(56) References Cited

U.S. PATENT DOCUMENTS

| | | | | | |
|---|---|---|---|---|---|
| 4,489,573 | A | * | 12/1984 | Engfelfried et al. | 66/8 |
| 5,031,421 | A | * | 7/1991 | Engelfried et al. | 66/8 |
| 5,275,020 | A | * | 1/1994 | Scherzinger | 66/8 |
| 5,493,876 | A | * | 2/1996 | Tsuchiya | 66/8 |

FOREIGN PATENT DOCUMENTS

| | | | | |
|---|---|---|---|---|
| DE | 2829678 | * | 1/1980 | 66/8 |
| DE | 3428855 | * | 5/1985 | 66/8 |
| DE | 40 07 253 A1 | | 9/1991 | |
| DE | 3316382 | * | 8/1992 | 66/8 |
| DE | 4128372 | * | 2/1993 | 66/8 |

* cited by examiner

*Primary Examiner*—Danny Worrell
(74) *Attorney, Agent, or Firm*—Michael J Striker

(57) ABSTRACT

A circular knitting machine with support disk (2) and a needle cylinder (4) fixed onto it with screws is described. According to the invention, an intermediate ring (17), elastically deformable in the radial direction, is arranged between support disk (2) and needle cylinder (4), through which the stresses that develop from different heat expansions are avoided between these two components.

10 Claims, 5 Drawing Sheets

CIRCULAR KNITTING MACHINE

The invention concerns a circular knitting machine with a support disk and needle cylinder attached to it with screws, Known circular knitting machines of this type, if designed as high-performance machines (for example, cylinder diameter 762 mm, 45 rpm, 96 systems), can heat up strongly, especially in the region of the cam and cylinder. The temperature differences caused by this lead to different heat expansion between the individual components. Numerous expedients are therefore already known, with which it is possible to compensate for different heat expansions. Such expedients are used, for example, to compensate for radial expansion in the region of the bearings of the generally annular support disks that carry the needle cylinders (DE 28 29 678 C2), to compensate for different radial heat expansion between the needle cylinders and sinker rings (DE 33 16 382 C2), to avoid deformation of the cam rings (DE 34 28 855 C2), or to compensate for axial displacements that can result in undesired changes in comb spacing, i.e., the spacing between the needle cylinder and dial in the knitting region (DE 41 28 372 A1).

It has now been found that different heat expansions in the lower region of the needle cylinder can also occur, especially where it is connected to the support disk. Temperature differences of 25° C., for example, are reached between these two parts, especially during running up of the circular knitting machine. One reason for this is probably poor heat transfer between the needle cylinder and the support disk, since the needle cylinder is attached to the support disk with only a few, for example six, screws distributed in the peripheral direction and does not or only inadequately lie—in the regions lying between the fastening sites—on the support disk especially if additional washers are used. As a result, the needle cylinder is heated more strongly than the support disk, and is therefore deformed radially more strongly than the disk. Significant stresses are created between the two components, which lead to strong distortion, especially in the needle cylinder, since it can buckle and bulge convexly in uncontrolled fashion between the fastening sites. If the friction force in the region of the fastening sites is no longer sufficient, the needle cylinder breaks off at one or more fastening sites, so that persistent radial displacements are produced between the needle cylinder and support disk that lead to unroundness of the needle cylinder. Such eccentricities lead to different spacings between the needle cylinder and the cam surface surrounding it during operation of the circular knitting machine, to different spacings between the knitting needles situated in the needle cylinder and the thread guides mounted in the machine frame, and therefore to an adverse effect on the quality of the knitwear being produced. Different comb spacings can also be produced by this.

Experiments have surprisingly led to the result that is problem cannot be avoided simply by using more and/or stronger screws for fastening of the needle cylinder to the support disk. Compensation means of the type described above might be of additional help, but would lead to costly design solutions and to solutions not always desired for other reasons. This is particularly true when an attempt is made to improve heat transfer between the needle cylinder and support disk, because this would lead to warping in the region of the bearings of the support disk and the means of compensation would have to be provided in the bearing region (DE 28 29 678 C2).

It is, therefore, an object of this invention to design a circular knitting machine of the generic type mentioned above so that critical roundness errors are avoided.

A further object of this invention is to design the knitting machine specified above such that the needle cylinder can expand substantially uniformly in a radial direction if temperature differences between the needle cylinder and the support disk occur.

Yet another object of this invention is to provide a circular knitting machine having a needle cylinder and a support disk therefor with simple means for compensating different radial expansions between the cylinder and the disk.

These and other objects are solved in accordance with this invention by means of an intermediate ring between the support disk and the needle cylinder which ring is elastically deformable in the radial direction.

Advantages of this invention are that the region between the needle cylinder and the support disk is configured elastically, so that this region can match with the expanding needle cylinder, and that the stresses (forces) in the screw connections become smaller. On this account, the needle cylinder can expand radially more uniformly, avoiding buckling and breaking.

Additional advantageous features of the invention are apparent from the subclaims.

The invention is further explained below in conjunction with the accompanying drawings by means of preferred embodiments. In the drawings.

Figure 1:
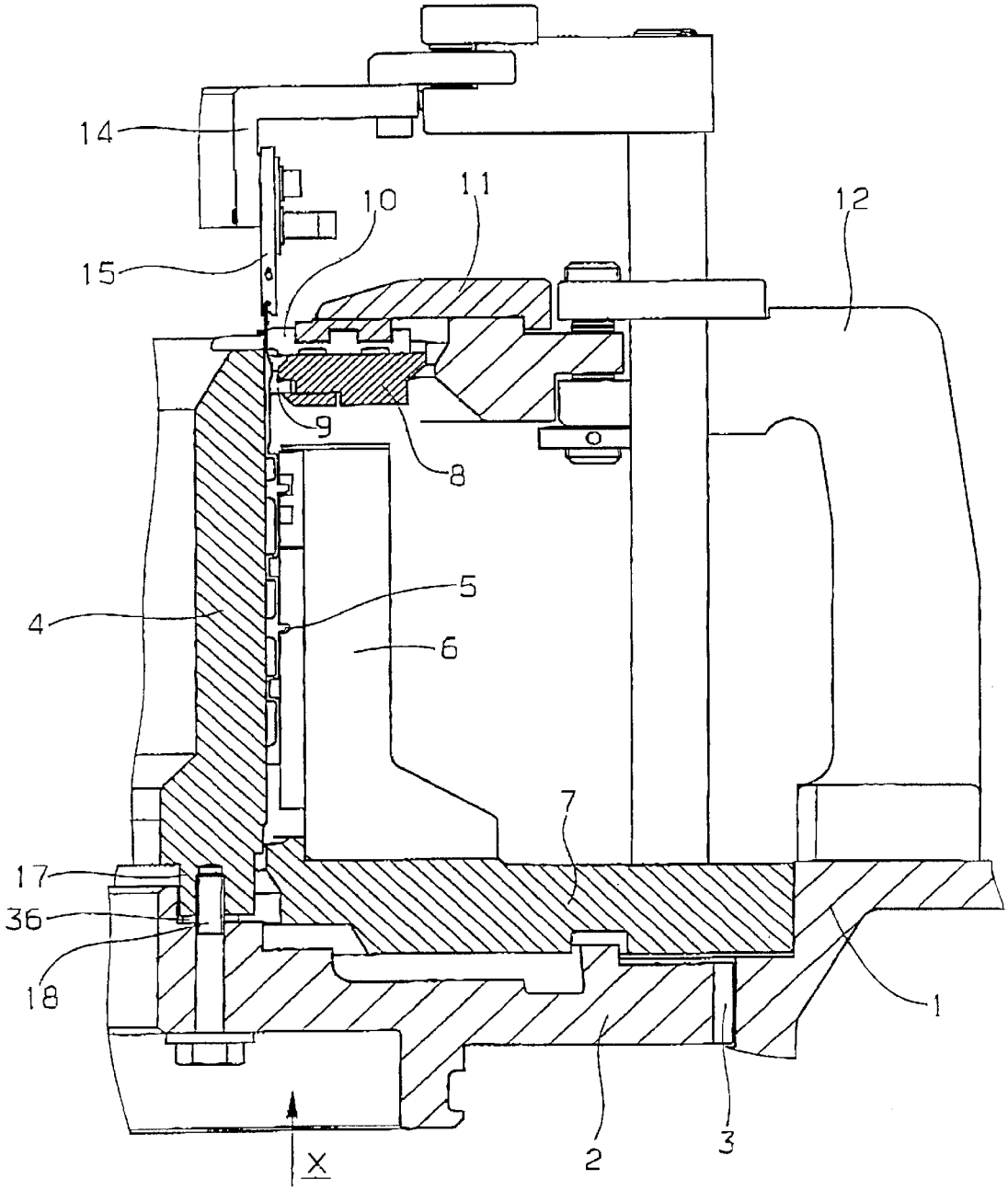
FIG. 1 shows a schematic axial section through a first embodiment of a circular knitting machine according to the invention.

Only the parts of a circular knitting machine necessary to understand the invention are shown in the drawings. The other parts of a circular knitting machine (for example, DE 40 07 253 C2) are known to one skilled in the art and therefore need not be further explained.

Figure 2:
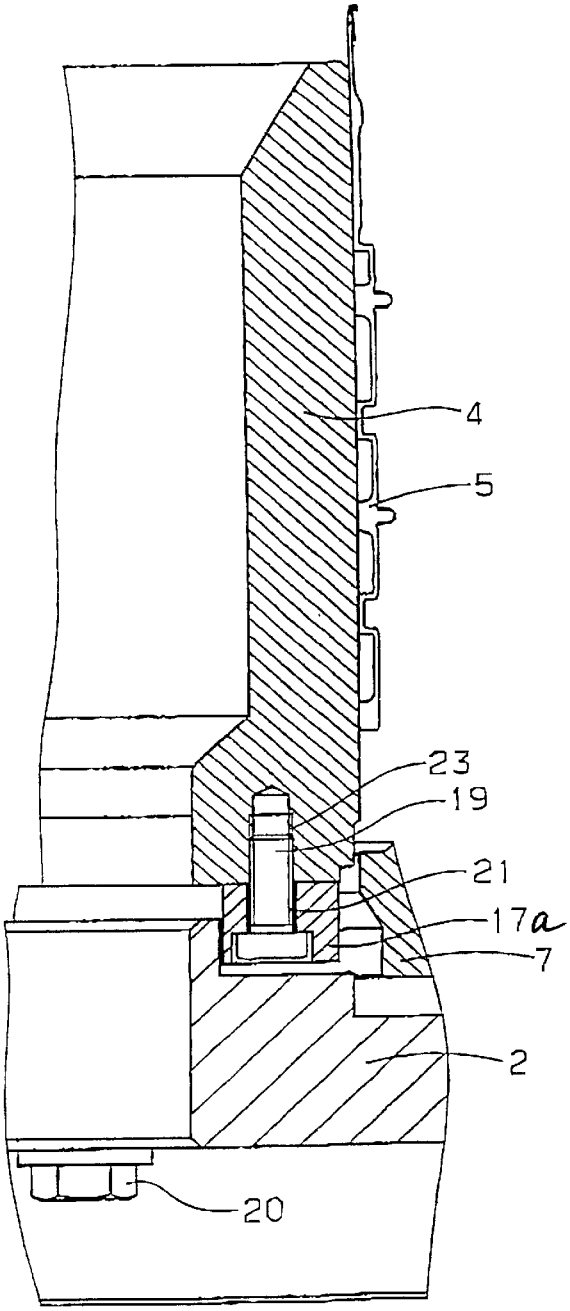
FIGS. 2 and 3 are enlarged partial sections according to FIG. 1 in different radial planes of a second embodiment of the circular knitting machine according to the invention.
Figure 3:
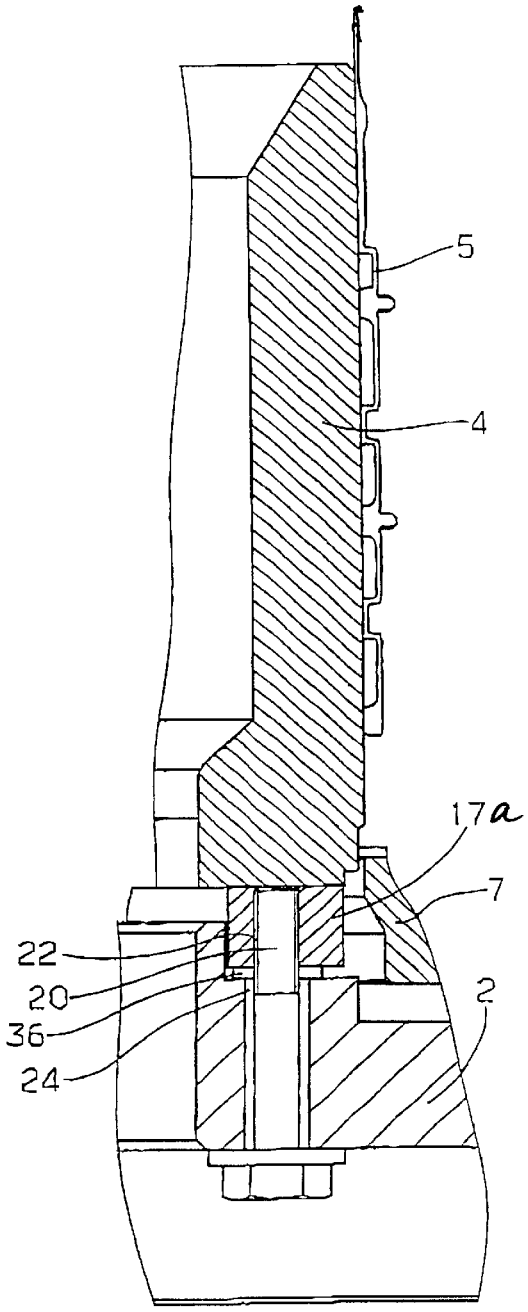

The circular knitting machine according to FIGS. 1 to 3 contains a frame with a stationary base plate 1, in which a support disk 2, generally designed annular, is mounted to rotate. The support disk 2 can be provided on its periphery with a toothing 3, which engages with a drive pinion that can be rotated by a machine drive (not shown). A needle cylinder 4 is supported on support disk 2, which is equipped in known fashion with knitting tools 5 in the form of needles or the like, and, when support disk 2 is driven, can rotate together with it around a vertical needle cylinder axis. The needle cylinder 4 is also enclosed by a stationary cylinder cam 6, which has cam parts that act on the butts of the knitting tools 5 and is mounted on a generally also annular support 7, mounted on the base plate 1.

The needle cylinder 4 is provided on the upper end in known fashion with a sinker ring 8, which lies, for example, on shoulders 9 of webs or walls inserted into the needle cylinder 4, and is equipped with knitting tools 10 in the form of sinkers. A stationary sinker cam 11 has cam parts acting on the butts of the knitting tools, is mounted on supports 12 rigidly connected to base plate 1 and is arranged above the sinker ring 8. Moreover, a thread guide ring 14, carrying thread guides 15 used to feed thread (not shown) to the knitting tools 5, 10 can also be mounted on additional stationary columns.

An intermediate ring 17, designed elastically deformable in the radial direction, is arranged according to the invention between support disk 2 and needle cylinder 4. As shown in FIG. 1, the intermediate ring 17 can consist, for example, of a hollow cylindrical shoulder or collar sufficiently thin in the radial direction and molded onto the lower end of the needle cylinder 4, and can be fastened to the support disk 2 by means of first screws 18 that extend through the support disk. As an alternative, the intermediate ring 17 can also be an appropriately designed collar, but one molded onto support disk 2. "Elastically deformable", in the context of the invention, is understood to mean that the intermediate ring 17 can expand slightly radially in the elastic region, just enough so that the tension forces occurring in intermediate ring 17 are taken up by screws 18 and the needle cylinder 4 can essentially expand uniformly elastically even in its lower region, i.e., directly above the intermediate ring 17, when the usual temperature and stress differences between support disk 2 and needle cylinder 4 occur during operation. In this manner, the heat expansion can be made reversible, i.e., the needle cylinder no longer breaks off in the region of the screw connections, but is deformed back into the original shape during cooling of the circular knitting machine, so that eccentricities remain within the required tolerances.

In a variant of the invention that is now deemed best, an intermediate ring 17*a* according to FIGS. 2 and 3 consists of a loose ring, produced in one piece neither with the needle cylinder 4 nor with the support disk 2. The intermediate ring 17*a* is fastened to needle cylinder 4 with first screws 19 and to support disk 2 with second screws 20. For this purpose, the intermediate ring 17*a* is provided, on the one hand, with through holes 21 and, on the other hand, with threaded holes 22, while the needle cylinder 4, on its lower end, has threaded holes 23 allocated to the first screws 19 and the support disk 2 has through holes 24 allocated to the second screws 20. The through holes 21 in intermediate ring 17*a* are preferably provided with an offset shoulder and designed so that they fully accommodate and can support the heads of screws 19. Fastening of needle cylinder 4 to support disk 2 then occurs by first fastening the intermediate ring 17*a* with the first screws 19 on needle cylinder 4 and mounting the assembly so formed onto the support disk 2, in order to tighten the second screws 20, inserted from the bottom through the holes 24, in the threaded holes 22 of intermediate nag 17*a*, the heads of screws 20, like those of screws 18 in FIG. 1, being supported on the bottom of intermediate ring 17*a* or 17, respectively.

In addition, means for axial height adjustment of the needle cylinder 4 can be provided. Such means contain, for example, one or more washers or spacers 36 arranged between intermediate ring 17, 17*a* and support disk 2. The spacing of the intermediate ring 17, 17*a*, and therefore the needle cylinder 4, from the top of support disk 2 can be precisely adjusted by choosing the correct number of spacers 36, arranged one above the other. Depending on the number of spacers 36, the intermediate ring 17, 17*a* is therefore supported on support disk 2 either only on the fastening sites or spacers 36, or more or less with its entire surface over its entire periphery.

Figure 4:
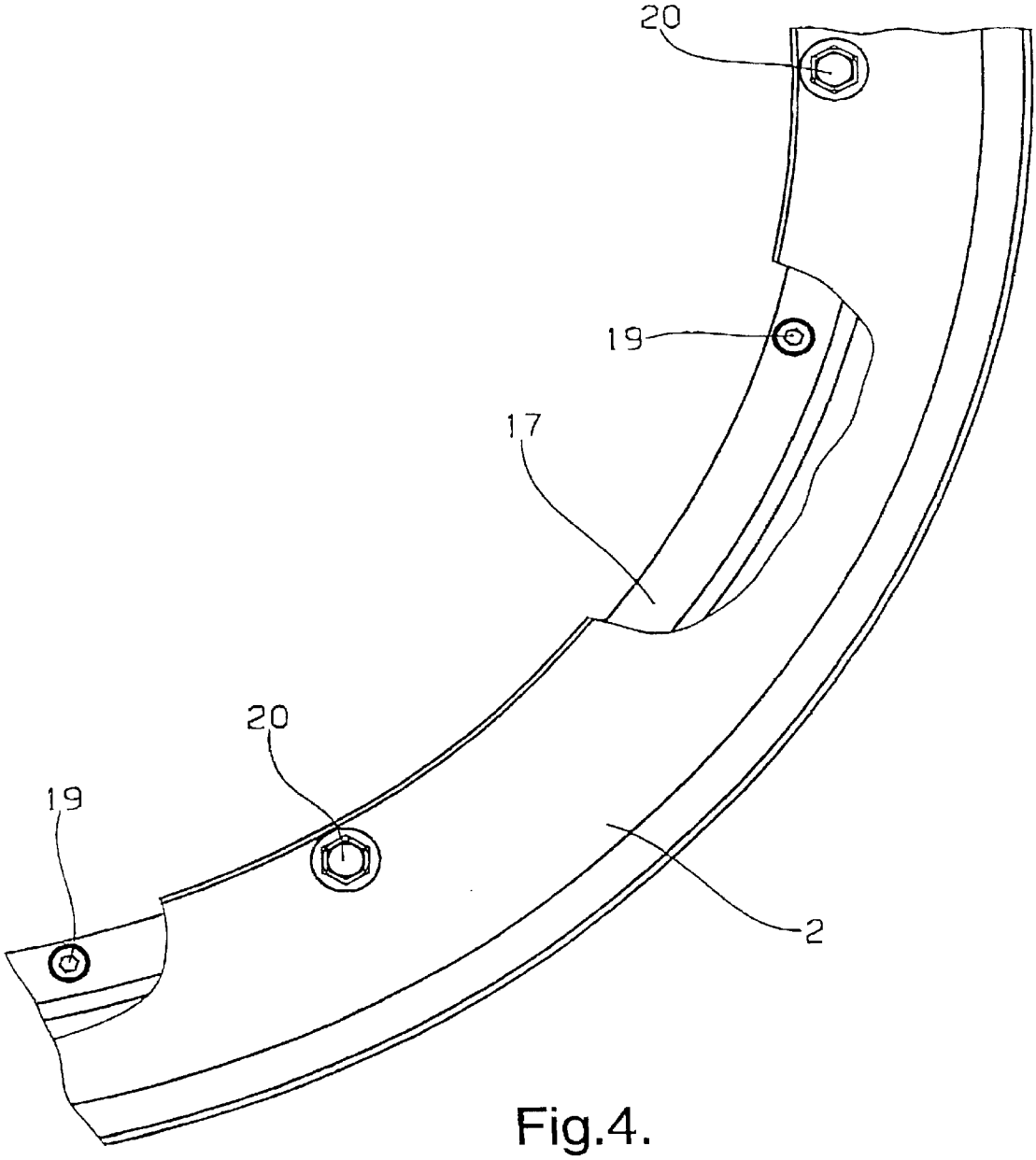
FIG. 4 shows a bottom view in the direction of arrow x of FIG. 1 to the circular knitting machine according to FIGS. 2 and 3.

As shown in FIG. 4, in particular, the first and second screws 19, 20 are preferably distributed in the peripheral direction of support disk 2 and needle cylinder 4, so that they all lie in different radial planes (with reference to the needle cylinder axis) and lie on a common circular arc with their axes. On this account, it is possible to choose the width of the intermediate ring 17*a*, measured in the radial direction, only just large enough as is required to form the holes 21 and threaded holes 22 and to establish the desired elasticity of intermediate ring 17*a*.

As fever shown in FIGS. 2, 3 and 4, the needle cylinder 4 is connected to intermediate ring 17*a* only at the fastening sites (or locations), determined by the first screws 19. This means that, with a needle cylinder diameter of 30 inches, arc segments having a length of about 400 mm, are present between each two fastening sites, if six first screws 19 are provided at equal angular spacing. The same applies to the embodiment according to FIG. 1, when six first screws 18 are used. When more or fewer screws 18, 19 are used, the lengths of the arc segments are correspondingly smaller or larger. The same naturally applies to the arc segments between the second screws 20. The arrangement in FIGS. 2 to 4 can then be chosen so 1 hat the second screws 20 are each arranged roughly in the center between two first screws 19. However, for reasons to be discussed fiber below, other relative arrangements between screws 19 and 20 in the peripheral direction of needle cylinder 4 are chosen with particular advantage.

Figure 5:
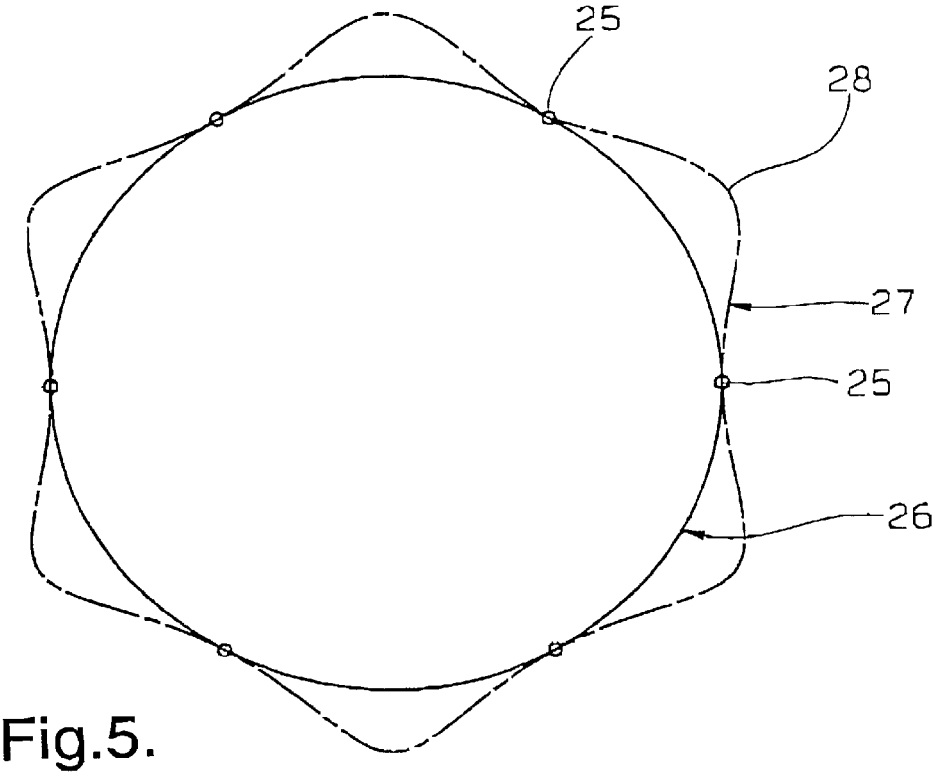
FIGS. 5 and 6 are rough schematic views of the expansion behavior of a needle cylinder without and with an intermediate ring according to the invention.

FIG. 5 schematically depicts the heat expansions of needle cylinder 4, which occur when the intermediate ring 17 or 17*a* is missing, i.e., when the needle cylinder is screwed directly onto support disk 2 at the fastening sites 25. The position of the fastening sites then stipulates the position of the fastening screws, it being assumed that all fastening sites 25 (viewed in the peripheral direction) have the same spacing from each other. Moreover, a circular contour 26 shows the periphery of support disk 2 in the region of the fastening sites 25, whereas a dashed line 27 shows the periphery of the needle cylinder 4 in the region of fastening sites 25, depicted on an exaggerated scale. This contour 27 is obtained when the needle cylinder is heated in the fastening region to a temperature that is greater than that of support disk 2 in the fastening region by a preselected difference and when it is assumed, in the interest of simplicity, that the needle cylinder 4 expands radially, whereas support disk 2 remains radially unaltered and the fastening sites 25 are therefore fixed spatially.

As is apparent from FIG. 5, the needle cylinder 2 bulges between two fixed fastening sites 25 along convex sections 28, or in wave-like fashion radially outward, so that a so-called "flower pattern" is produced. Significant stresses that can lead to the aforementioned irreversible breaks and eccentricities in the region of fastening sites 25 are produced by this.

Figure 6:
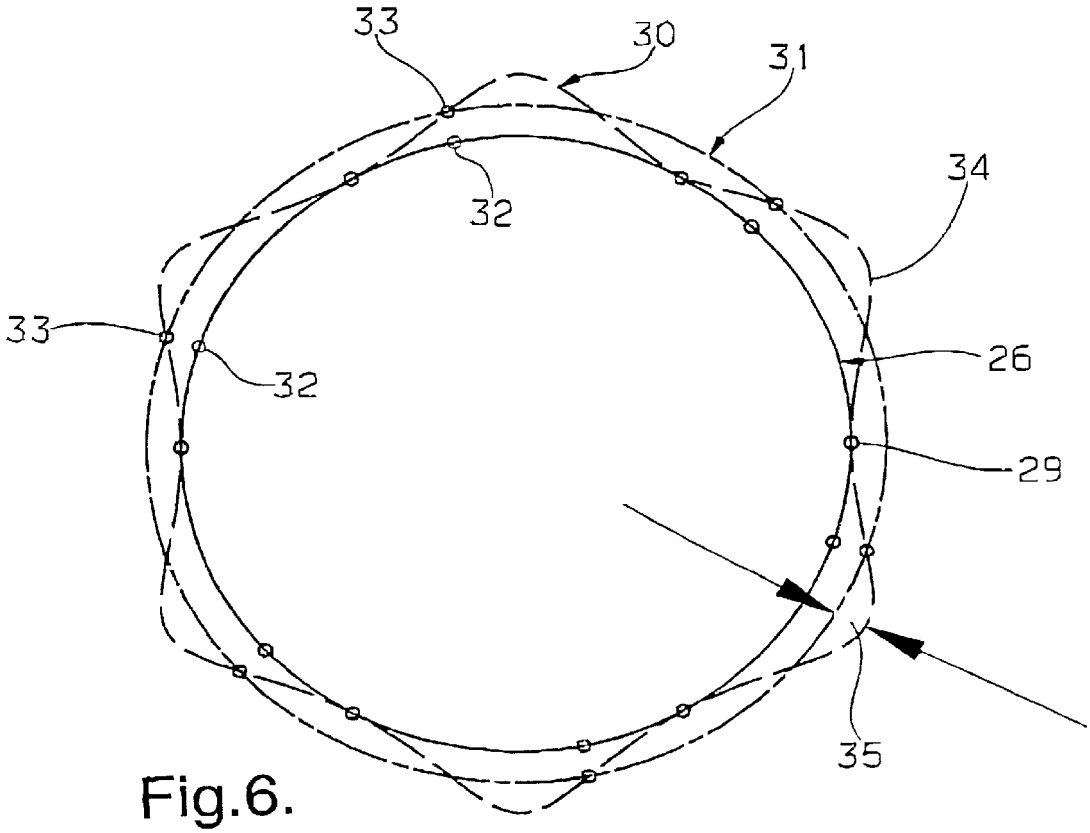

On the other hand, FIG. 6 shows, with reference to the embodiment according to FIGS. 2 and 3, how this problem is sharply reduced when the invention is used. As in FIG. 5, reference number 26 indicates the essentially unaltered contour of the support disk 2 in the region of fastening sites 29. The fastening sites 29, however, here denote the positions of the second screws 20 (FIGS. 3 and 4), by means of which the support disk 2 is connected to intermediate ring 17*a*, whose contour in the heated state is indicated by a dashed line 30. FIG. 6 also shows, with a dash-dot line, the outer contour 31 of needle cylinder 4 in the fastening region provided that the needle cylinder can expand uniformly outward in radial fashion because of heat expansion. Fastening sites 32 between the needle cylinder 4 and intermediate ring 17*a* denote the positions of the first screws 19

(FIGS. 2 and 4) in the cold state of needle cylinder 4, whereas fastening sites 33 show the positions of the screws 19 in the heated state. Finally, it is assumed that the conditions shown in FIG. 6 are retained when the temperature difference between needle cylinder 4 and support disk 2 is the same as was assumed for causing the deformations in FIG. 5. It is further assumed that the intermediate rig 17*a* is heated to essentially the same temperature as needle cylinder 4.

On creation of the preselected temperature difference, the intermediate ring 17*a* is therefore deformed along the contour 30, essentially as shown in FIG. 5 for the needle cylinder 4 along contour 27. Since the needle cylinder 4, however, is no longer directly attached to the support disk 2, but only to intermediate ring 17*a*, this intermediate ring 17*a*, because of its more limited rigidity, can largely compensate for the radial buckling of needle cylinder 4 that otherwise develops from the temperature difference, so that the needle cylinder 4 itself remains essentially circular or cylindrical and expands uniformly. In other words, in the region of the fastening sites 29, assumed to be fixed, the flexible intermediate ring 17*a* expands differently than in the region of fastening sites 32, so that the fastening sites 32 migrate outward radially in the direction of fastening sites 33, as the radial expansion of needle cylinder 4 stipulates.

However, as further shown in FIG. 6, the intermediate ring 17*a* seeks to achieve its greatest radial expansion 34 relative to needle cylinder 4 in the center between two fastening sites 29, whereas needle cylinder 4 seeks to assume contour 31. The difference in expansions resulting from this is shown in FIG. 6 by a dimension 35. If the fastening sites 32 had therefore been placed precisely in the center between two fastening sites 29, the needle cylinder 4 in the heated state would then also be exposed to forces directly radially outward at the sites 33 corresponding to them, which would certainly be smaller than an FIG. 5, but still present. In order to rule out stresses caused by this, it is proposed according to the invention that needle cylinder 4 be fastened to intermediate ring 17*a* at locations where both are roughly subject to the same radial expansion. These locations in FIG. 6 are the fastening sites 32, since they correspond in the heated state to sites 33, at which the intermediate ring 17*a* has expanded by the same extent as needle cylinder 4. Needle cylinder 4 can therefore be deformed unhampered without becoming unround.

The locations where the needle cylinder 4 and the intermediate ring 17*a* will assume the same radial expansion can be determined in the individual case by means of the expected or measured temperature differences. It will then be expedient to determine the position of the fastening sites 32 according to which temperature differences occur at the operating temperature of the circular knitting machine, so that virtually no forces occur between the needle cylinder 4 and intermediate ring 17*a*. Depending on the individual case, the fastening sites 32 can therefore also lie at radial locations other than the fastening sites 33 in the heated state.

As shown in FIG. 6, the fastening sites 32 lie somewhere between the fastening sites 29 and the locations 34 of maximum expansion of intermediate ring 17*a*, so that the fastening sites 32 do exhibit spacings from each other corresponding to the spacings of fastening sites 29, but do not lie in the center between two neighbored fastening sites 29. It is essential that the fastening sites 32 be offset in the peripheral direction relative to fastening sites 29 and not lie in the same radial plane.

Figure 7:
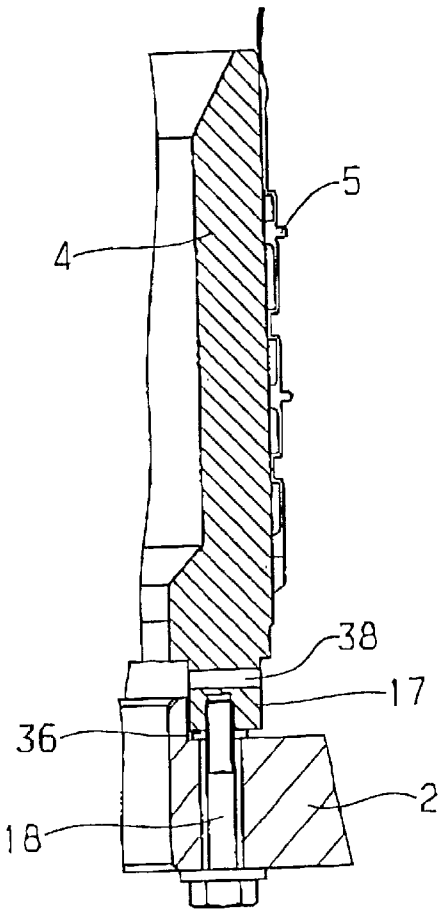
FIG. 7 shows a section corresponding to FIG. 2 through a third embodiment of the circular knitting machine according to the invention.
Figure 8:
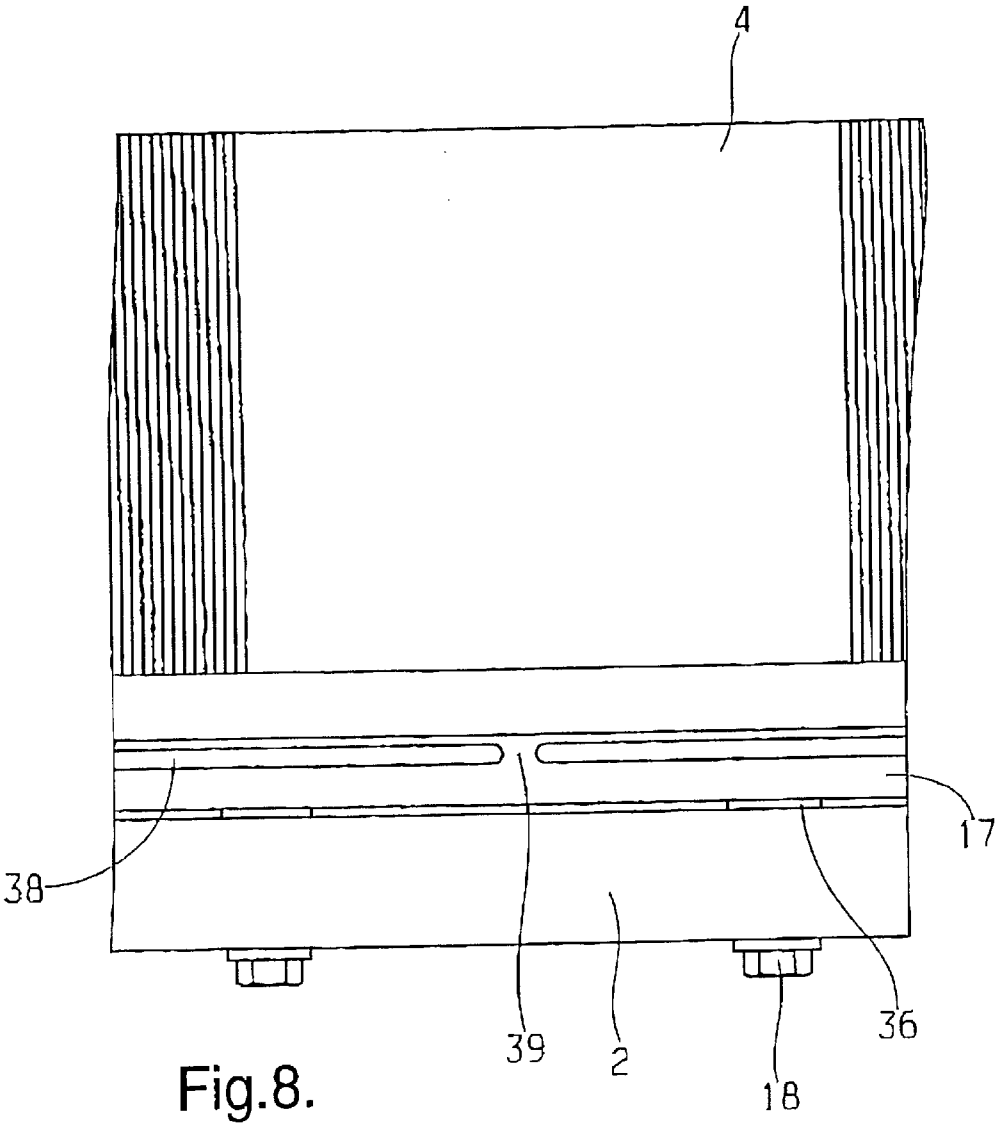
FIG. 8 shows a schematic front view of the circular knitting machine according to FIG. 7, for example, from the right in FIG. 7.

FIGS. 7 and 8 show a third embodiment of the circular knitting machine according to the invention, same parts being provided with the same reference numbers as in FIG. 1. In this case, the intermediate ring 17 molded onto needle cylinder 4 is designed elastically deformable in that it is provided with radially continuous slits 38 limited in the peripheral direction. Because of this, the intermediate ring 17 consists of two sections, arranged one above the other, in the direction of the needle cylinder axis, and connected to each other by elastically deformable webs or protrusions 39 left between slits 38. The lower section of intermediate ring 17 is then fastened to the support disk 2 with the first screws 18, in similar fashion to FIG. 1. As an alternative, it would also be possible to mold the intermediate ring 17 onto the needle cylinder at its top by means of webs 39. In both cases, the elasticity of the intermediate rig 17 can be essentially determined by selecting the height and cross section of webs 39.

Whereas the needle cylinder 4 generally consists of steel, the support disk 2 is generally made of cast iron. The intermediate ring 17, 17*a* preferably also consists of steel, its cross sectional shape and/or the webs 39 or the like determining its elastic deformability. However, it would also be possible to establish the required elasticity by selecting a steel having greater elasticity relative to the needle cylinder material.

The invention is not restricted to the described embodiments, which can be modified in a variety of ways. In particular, fastening between the needle cylinder 4 and the intermediate ring 17, 17*a* and/or between ring 17, 17*a* and the support disk 2 can occur at more or fewer than six locations. The arc segments of intermediate ring 17 or 17*a*, needle cylinder 4 and support disk 2 situated between fastening sites can also be chosen differently. The cross sectional shape of intermediate ring 17, 17*a* can also be different from the depicted rectangular cross sectional shape, in which the contact surfaces between intermediate ring 17, 17*a* and support disk 2 or needle cylinder 4 need not run perpendicular to the needle cylinder axis. The axes of screws 18, 19 and 20, as is apparent from FIGS. 1 to 3, 7 and 8, correspondingly need not be arranged parallel to the needle cylinder axis. In this respect, numerous other configurations are possible tat can also depend on the type of circular knitting machine. Moreover, the intermediate ring 17, 17*a* can also have a greater or smaller radial width than the part of the needle cylinder 4 lying on it, depending on the desired rigidity and elasticity. The height of intermediate ring 17, 17*a* is also chosen as a function of the desired rigidity and elasticity, but must be at least large enough so that a sufficient number turns of the threaded holes 22 (FIG. 3) can be made. In addition, the intermediate ring 17, 17*a* need not have an exact cylindrical shape between the different fastening sites, since it lies freely in this region It would also be possible to provide an intermediate ring 17*a*, consisting of several segments separated by a gap in the peripheral direction, each segment being connected by at least a first and second screw 19, 22 to the support disk 2 and the needle cylinder. The fastening sites 29, 32 also need not all lie on a common circular line (FIG. 3), since the fastening sites 29, in particular, can have different radial spacings than the fastening sites 32 from the needle cylinder axis. It also does not matter whether a circular knitting machine with a rotatable needle cylinder and a stationary cam or a circular knitting machine with a stationary needle cylinder and a rotatable cam is involved, or whether the circular knitting machine as a sinker ring and/or dial, in addition to the needle cylinder. Finally, it is understood that the different features can also be used in combinations different from those depicted and described.

It will be understood each of the elements described above, or two ore more together, may also find a useful application n other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. Circular knitting machine comprising: a support disk (2), a needle cylinder (4) attached to said support disk (2) by means of screws and an intermediate ring (17, 17*a*) being arranged between support disk (2) and needle cylinder (4), said intermediate ring (17, 17*a*) being elastically deformable in a radial direction.

2. Circular knitting machine according to claim 1, wherein said intermediate ring (17, 17*a*) is fastened to said needle cylinder (4) with first screws (19) and to said support disk (2) with second screws (20).

3. Circular knitting machine according to claim 1, wherein said first and second screws (19, 20) are each arranged in different radial planes.

4. Circular knitting machine according to claims 2 or 3, wherein said second screws (20) are each arranged substantially in a center between two of said first screws (19).

5. Circular knitting machine according to claim 2 or 3, wherein said second screws (20) are each arranged at sites (32) where said needle cylinder (4) and said intermediate ring (17, 17*a*) are subject substantially to a same radial expansion at a preselected relative temperature difference.

6. Circular knitting machine according to claim 2, wherein said intermediate ring (17*a*) is assembled from segments separated by gaps in a peripheral direction, each segment being connected to said needle cylinder (4) by at least one first screw (19) and to said support disk (2) by at least one second screw (20).

7. Circular knitting machine according to claim 1, wherein said intermediate ring (17) is produced in one piece with said needle cylinder (4).

8. Circular knitting machine according to claim 7, wherein said intermediate ring (17) is provided with radially continuous slits (38) interrupted by webs (39) in a peripheral direction.

9. Circular knitting machine according to claim 6 or 7, wherein said intermediate ring (17) is connected to said support disk (2) by fast screws (18).

10. Circular knitting machine according to claim 1, wherein said intermediate ring (17) is Integrally connected to said needle cylinder (4) in one piece by means of webs (39) spaced in a peripheral direction.

* * * * *